US009149168B2

(12) United States Patent
Baek et al.

(10) Patent No.: US 9,149,168 B2
(45) Date of Patent: Oct. 6, 2015

(54) ROBOT CLEANER

(71) Applicant: LG Electronics Inc., Seoul (KR)

(72) Inventors: Ohhyun Baek, Changwon-si (KR); Inbo Shim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 127 days.

(21) Appl. No.: 13/790,932

(22) Filed: Mar. 8, 2013

(65) Prior Publication Data

US 2013/0232720 A1 Sep. 12, 2013

(30) Foreign Application Priority Data

Mar. 8, 2012 (KR) ..... 10-2012-0024148

(51) Int. Cl.

| | |
|---|---|
| ***A47L 9/00*** | (2006.01) |
| ***A47L 5/12*** | (2006.01) |
| ***A47L 9/06*** | (2006.01) |

(52) U.S. Cl.

CPC . *A47L 9/009* (2013.01); *A47L 5/12* (2013.01); *A47L 9/00* (2013.01); *A47L 9/0686* (2013.01); *A47L 2201/00* (2013.01)

(58) Field of Classification Search

CPC ..... A47L 9/19; A47L 9/2842; A47L 9/2857; A47L 5/30; A47L 2201/00; E01H 1/0836; E01H 1/0827

USPC ..... 15/340.1, 319, 339

See application file for complete search history.

(56) References Cited

U.S. PATENT DOCUMENTS

| | | | | |
|---|---|---|---|---|
| 6,481,515 | B1 * | 11/2002 | Kirkpatrick et al. | 180/65.1 |
| 6,741,054 | B2 * | 5/2004 | Koselka et al. | 318/445 |
| 7,013,528 | B2 * | 3/2006 | Parker et al. | 15/403 |
| 7,246,405 | B2 * | 7/2007 | Yan | 15/340.1 |
| 7,320,149 | B1 * | 1/2008 | Huffman et al. | 15/320 |
| 7,389,166 | B2 * | 6/2008 | Harwig et al. | 701/23 |
| 8,452,450 | B2 * | 5/2013 | Dooley et al. | 700/258 |
| 2003/0178894 | A1 | 9/2003 | Ghent | |

FOREIGN PATENT DOCUMENTS

| | | | |
|---|---|---|---|
| CN | 1575721 | A | 2/2005 |
| CN | 1830375 | A | 9/2006 |
| EP | 1935308 | B1 | 5/2011 |
| EP | 2737659 | A2 | 6/2014 |
| EP | 2737660 | A2 | 6/2014 |
| KR | 1020030002381 | A | 1/2003 |
| KR | 1020070028841 | A | 3/2007 |
| KR | 10-2007-0101432 | A | 10/2007 |
| KR | 10-1080004 | B1 | 11/2011 |
| WO | 2006/046053 | A1 | 5/2006 |

* cited by examiner

*Primary Examiner* — Dung Van Nguyen

(74) *Attorney, Agent, or Firm* — Dentons US LLP

(57) ABSTRACT

Provided is a robot cleaner. The robot cleaner includes a main body having a plurality of fixing slots that are spaced apart from each other, a moving device providing a driving force for moving the main body, and a bracket on which a cleaning member is mounted, the bracket including a plurality of fixing ribs that horizontally move and are respectively coupled to the plurality of fixing slots.

20 Claims, 5 Drawing Sheets

ROBOT CLEANER

CROSS-REFERENCE TO RELATED APPLICATIONS

The present application claims priority under 35 U.S.C. 119 and 35 U.S.C. 365 to Korean Patent Application No. 10-2012-0024148 (filed on Mar. 8, 2012), which is hereby incorporated by reference in its entirety.

BACKGROUND

The present disclosure relates to a robot cleaner.

In general, cleaners are home appliances which suction and remove foreign substances from the floor. Among these cleaners, a cleaner for automatically performing a cleaning operation is called a robot cleaner. The robot cleaner suctions and removes foreign substances from the floor while being moving by a driving force of a motor operated by a battery.

In recent, robot cleaners that can wipe the floor as well as suction foreign substances are being released.

A moving device for moving a main body and a suction device for suctioning air containing foreign substances from an object to be cleaned are provided within the main body of such a robot cleaner.

A damping cloth for wiping is mounted on a bottom surface of the main body. The damping cloth is mounted on the bottom surface of the main body by a bracket. The bracket may be detachably disposed on the main body by a magnetic force. For example, a permanent magnet is disposed on the bracket. Also, since a permanent magnet or metal member is disposed on the bottom surface of the main body, the bracket may be fixed to the bottom surface of the main body.

SUMMARY

Embodiments provide a robot cleaner.

In one embodiment, a robot cleaner includes: a main body having a plurality of fixing slots that are spaced apart from each other; a moving device providing a driving force for moving the main body; and a bracket on which a cleaning member is mounted, the bracket including a plurality of fixing ribs that horizontally move and are respectively coupled to the plurality of fixing slots.

In another embodiment, a robot cleaner includes: a main body including a first fixing slot and a second fixing slot spaced apart from the first fixing slot; and a bracket on which a cleaning member is mounted, the bracket including a first fixing rib inserted into the first fixing slot and a second fixing rib inserted into the second fixing slot, wherein each of the fixing ribs of the bracket is inserted into each of the fixing slots of the main body in a direction parallel to a moving direction of the main body.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
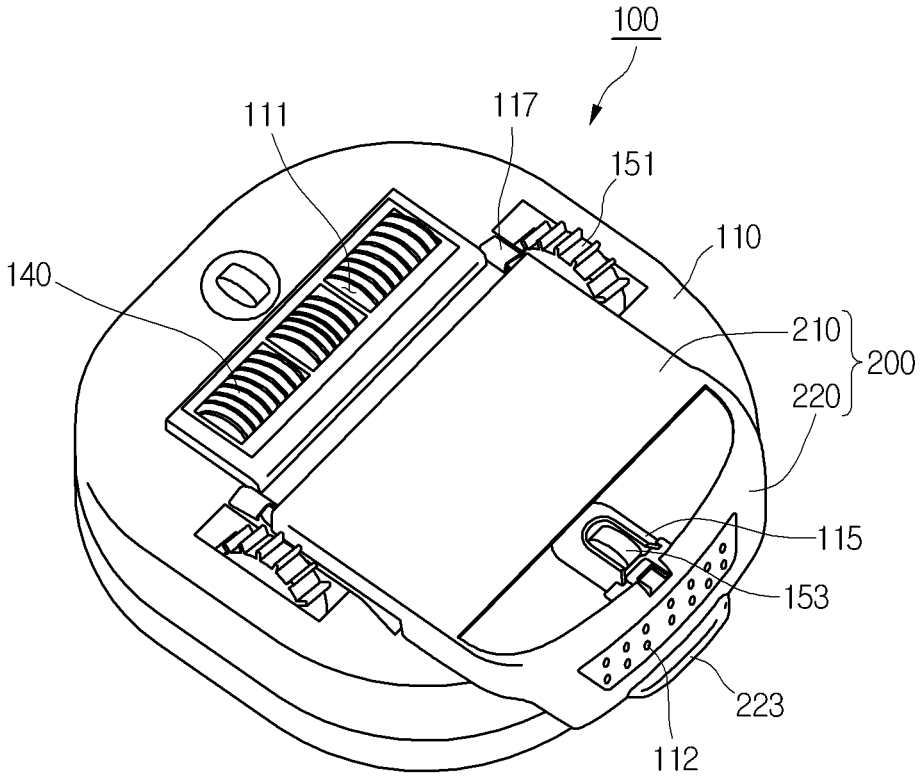
FIG. 1 is a perspective view of a robot cleaner according to an embodiment.
Figure 2:
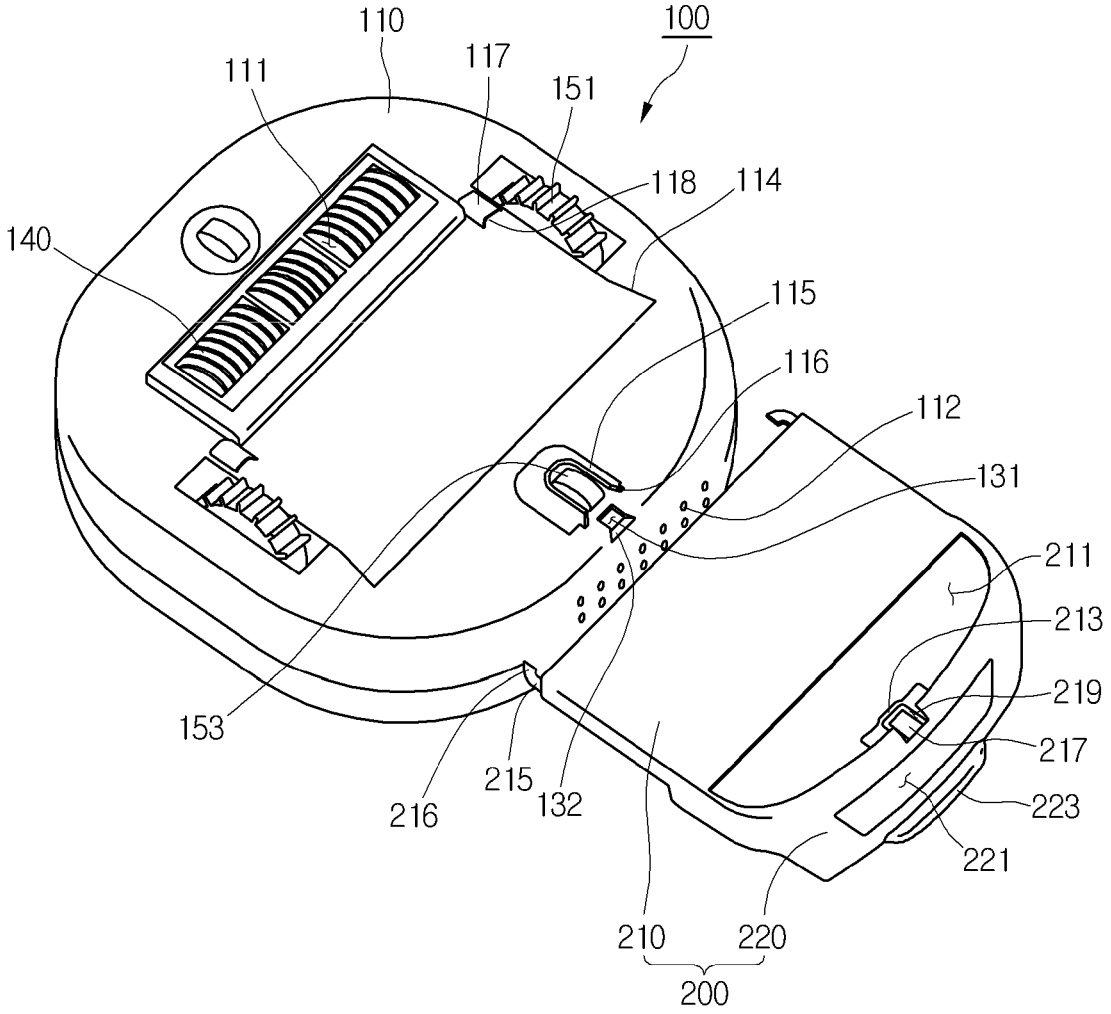
FIG. 2 is a perspective view of a state in which a bracket is separated from a main body in a robot cleaner according to an embodiment.
Figure 3:
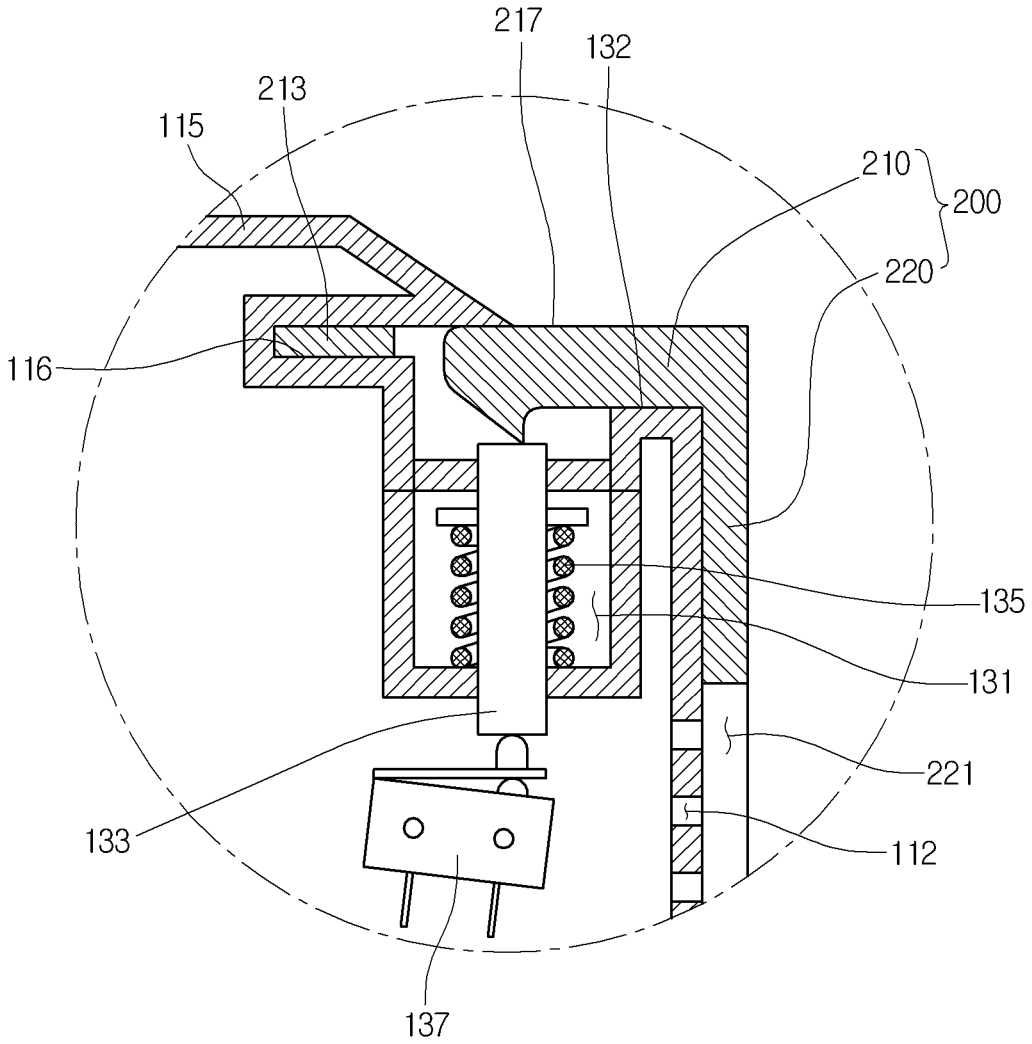
FIG. 3 is a longitudinal sectional view illustrating a portion of the robot cleaner according to an embodiment.
Figure 4:
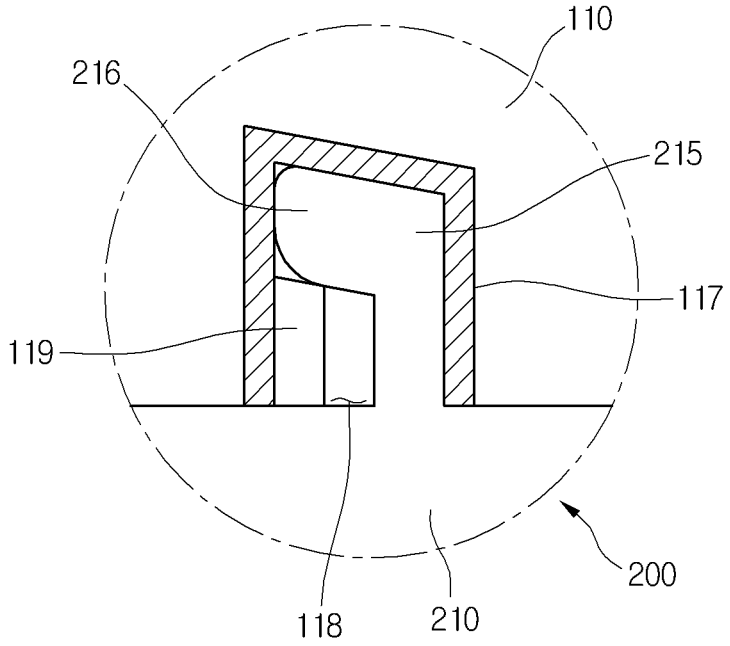
FIG. 4 is a cross-sectional view illustrating a portion of the robot cleaner according to an embodiment.

FIG. 1 is a perspective view of a robot cleaner according to an embodiment, FIG. 2 is a perspective view of a state in which a bracket is separated from a main body in a robot cleaner according to an embodiment, FIG. 3 is a longitudinal sectional view illustrating a portion of the robot cleaner according to an embodiment, and FIG. 4 is a cross-sectional view illustrating a portion of the robot cleaner according to an embodiment.

Referring to FIGS. 1 and 2, a robot cleaner 100 includes a main body 110 that has an approximately polygonal shape or cylindrical shape with top, bottom, and circumferential surfaces, but the present disclosure is not limited thereto. Hereinafter, for convenience of description, the circumferential surfaces of the main body 110 corresponding to front and rear sides in a moving direction of the main body 110 are called front and rear surfaces of the main body 110, respectively. Also, the rest surfaces of the circumferential surface of the main body 110 disposed between the front and rear surfaces of the main body 110 are called side surfaces of the main body 110.

A nozzle opening 111 is defined in the bottom surface of the main body 110. Air containing foreign substances is suctioned into the main body 110 through the nozzle opening 111. The nozzle opening 111 is defined by cutting a portion of a front end of the bottom surface of the main body 110.

Also, a discharge hole 112 is defined in a side of the circumferential surface of the main body 110. The air suctioned into the main body 110 and then filtered is discharged to the outside of the main body 110 through the discharge hole 112. The discharge hole 112 may be defined in a side of the rear surface of the main body 110.

A plurality of guide ribs 113 are disposed on the bottom surface of the main body 110. The guide ribs 113 may guide movement of the bracket 200 that will be described later. The guide ribs 113 are horizontally spaced apart from each other on the bottom surface of the main body 110. Each of the guide ribs 113 longitudinally extends from the bottom surface of the main body 110 in front and rear directions. An inclination guide part 114 is disposed on the bottom surface of the main body 110. The inclination guide part 114 guides the movement of the bracket 200 when the bracket 200 is initially mounted on the main body 110. Here, the inclination guide part 114 may have a rear width relatively greater than a front width thereof. That is, the inclination guide part 114 may have a horizontal length of a rear end (that is away from a driving wheel 151) greater than that of a front end (that is close to the driving wheel 151) thereof.

This is done for a reason in which the bracket 200 is mounted in position on the main body 110 even though the bracket 200 moves with respect to the main body 110 in a state where the bracket 200 is not precisely aligned in initial position with respect to the guide ribs 113.

A protrusion 115 is disposed on the bottom surface of the main body 110. A portion of the bottom surface of the main body 110 protrudes downward to define the protrusion 115. The protrusion 115 may be disposed on a rear end of the main body 110.

Referring to FIG. 3, a first fixing slot 116 is defined in the bottom surface of the main body 110. A first fixing rib 213 that will be described later is inserted into the first fixing slot 116. For example, after a portion of the protrusion 115 adjacent to the bottom surface of the main body 110 is cut forward from a rear direction, the first fixing slot 116 may be defined by the bottom surface of the main body 110 and the cutout portion of the protrusion 115.

Referring to FIGS. 1 and 2, a plurality of fixing housings 117 is disposed on the main body 110. The plurality of fixing housings 117 are horizontally spaced apart from each other and respectively disposed adjacent to front ends of the guide ribs 113. The fixing housing 117 may have a substantially polygonal shape with an opened rear side.

Also, referring to FIG. 4, a plurality of fixing slots 118 and a plurality of hook protrusions 119 are disposed on the main body 110. A second fixing rib 215 that will be described later is inserted into each of the second fixing slots 118. Also, a second fixing rib 215 inserted into the second fixing slot 118 is hooked on each of the hook protrusion 119. The second fixing slot 118 may be defined by the bottom surface of the main body 110 and an inner surface of the fixing housing 117. Thus, the second fixing slot 118 may have an opened rear side. Also, the hook protrusion 119 is disposed inside the second fixing slot 118. Substantially, the hook protrusion 119 may protrude in a direction inclined at a predetermined angle with respect to a direction in which the second fixing rib 215 is inserted into the second fixing slot 118, e.g., a direction perpendicular to the direction in which the second fixing rib 215 is inserted into the second fixing slot 118.

In the current embodiment, the first and second fixing slots 116 and 118 are spaced apart from each other in front and rear directions on the bottom surface of the main body 110. For example, the first fixing slot 116 may be defined backward from the rear end of the guide rib 113. Also, the second fixing slot 118 may be disposed adjacent to the front end of the guide rib 113. Here, the plurality of second fixing slots 118 are horizontally spaced apart from each other. Thus, the first fixing slot 116 may be defined in a position relatively closer to a rear end of the bottom surface of the main body 110 than the second fixing slot 118. However, the present disclosure is not limited to the positions of the first and second fixing slots 116 and 118.

Referring again to FIGS. 1 and 2, a driving groove 131 is defined in the bottom surface of the main body 110. A portion of the bottom surface of the main body 110, for example, a rear end of the bottom surface of the main body 110 adjacent to the rear surface of the main body 110 is recessed downward to define the driving groove 131. In the current embodiment, the driving groove 131 is defined in a rear side of the first fixing slot 116, i.e., a rear side of the protrusion 115. Also, an entrance opening 132 is defined in a lower end of a rear surface of the driving groove 131. A portion of a lower end of the rear surface of the main body 110 is cut to communicate with the driving groove 131, thereby defining the entrance opening 132.

Referring to FIG. 4, a detection device is disposed on the main body 110. The detection device detects whether the bracket is mounted. The detection device may include a driving member 133, an elastic member 135, and a micro switch 137. The driving member 133 is movably disposed within the main body 110. Here, at least one portion of the driving member 133 is disposed within the driving groove 131. Also, when a driving rib 217 that will be described later is inserted into the driving groove 131, the driving member 133 moves downward. The elastic member 135 applies an elastic force for moving the driving member 133 upward to the driving member 133. Thus, when an external force applied into the driving member 133 is removed, i.e., the driving member 133 is not driven by the driving rib 217, the driving member 133 moves upward by the elastic force of the elastic member 135. The micro switch 137 is turned on or off by the driving member 133. For example, the micro switch 137 is turned on when the driving member 133 is driven by the driving rib 217 to move downward. Also, the micro switch 137 is turned off when the driving member 133 moves upward by the elastic force of the elastic member 135. Alternatively, the driving member 133 is rotatably disposed within the main body 110. In this case, the driving member 133 rotates by the driving rib 217. Thus, the micro switch 137 may be turned on or off.

Although not shown, a suction device is disposed within the main body 110. The suction device provides a suction force for suctioning air containing foreign substances through the nozzle opening 111 and discharging the filtered air through the discharge hole 112.

Referring again to FIGS. 1 and 2, an agitator 140 is disposed in the main body 110. The agitator 140 is disposed within the main body 110 corresponding to an upper side of the nozzle opening 111. The agitator 140 may remove foreign substances from an object to be cleaned through the nozzle opening 111.

The driving wheel 151 and an auxiliary wheel 153 are disposed in the main body 110. The driving wheel 151 rotates by a driving force provided from a driving motor (not shown) to move the main body 110. The auxiliary wheel 153 may rolled by the movement of the main body 110 to support the main body 110. For example, the auxiliary wheel 153 may be rollably disposed on a bottom surface of the protrusion 115.

Also, the bracket 200 is detachably disposed on the main body 110. The bracket 200 is configured to mount a damping cloth (not shown) (or a cleaning member). The bracket 200 moves in a horizontal direction, for example, front and rear directions with respect to the main body 110 so that the bracket 200 is mounted on or separated from the main body 110. The bracket 200 may have a plate shape. For example, in the current embodiment, the bracket 200 may have a plate shape so that the bracket 200 is coupled with the same shape as a portion of the bottom surface of the main body 110 and a portion of the rear surface of the main body adjacent to the portion of the bottom surface of the main body 110. The bracket 200 may include a first part 210 and a second part 220. For example, the first and second parts 210 and 220 may be integrated with each other.

In detail, the damping cloth may be disposed on the first part 210. The damping cloth is mounted on a bottom surface of the first part 210. For example, in a state where the damping cloth is disposed to surround portions of bottom and top surfaces of the first part 210, a portion of the damping cloth is attached to a coupling unit (if is not limited thereto, for example, Velcro), disposed on the top surface of the first part 210. Thus, the damping cloth may be mounted on the first part 210. When the bracket 200 is mounted on the main body 110, the first part 210 is in contact with the bottom surface of the main body 110 or spaced downward from the bottom surface of the main body 110. The first part 210 may have a plate shape with a horizontal width corresponding to a distance between the plurality of guide ribs 113.

A first opening 211 is defined in the first part 210. A portion of the first part 210 is cut to define the first opening 211. The first opening 211 is configured to substantially avoid interference between the protrusion 115 and auxiliary wheel 153 and the first part 210.

The first fixing rib 213 is disposed on the first part 210. When the bracket 200 is mounted on the main body 110, the first fixing rib 213 is inserted into the first fixing slot 116. The first fixing rib 213 is horizontally longitudinally disposed on a side of the first part 210 corresponding to a rear end of the first opening 211.

Referring again to FIG. 4, the plurality of second fixing ribs are disposed on the first part 210. When the bracket 200 is mounted on the main body 110, the second fixing rib 215 is inserted into the second fixing slot 118. The second fixing rib 215 extends forward from a front edge of the first part 210. Hooks 216 are disposed on front ends of the second fixing ribs 215. The hooks 216 respectively protrude from the front ends of the second fixing ribs 215 to face each other. When the second fixing rib 215 is inserted into the second fixing slot 118, the hook 216 is hooked on the hook protrusion 119. While the hook 216 is hooked on the hook protrusion 119, the second fixing rib 215 is elastically deformed with respect to the first part 210.

When the first and second fixing ribs 213 and 215 are respectively inserted into the first and second fixing slots 116 and 118, and the second fixing rib 215 is hooked on the hook protrusion 119, vertical and horizontal movement of the bracket 200 with respect to the main body 110 may be restricted.

In detail, when the first fixing rib 213 is inserted into the first fixing slot 116, the vertical and forward movement of the bracket 200 with respect to the main body 110 may be restricted. Also, when the second fixing rib 215 is inserted into the second fixing slot 118, the vertical and left/right movement of the bracket 200 with respect to the main body 110 may be restricted. Also, when the second fixing rib 215 is hooked on the hook protrusion 119, the backward movement of the bracket 200 with respect to the main body 110 may be restricted. That is to say, since the first fixing rib 213 is inserted into the first fixing slot 116, the movement of the bracket 200 in one direction of the horizontal direction in which the bracket 200 is mounted on the main body 110 may be restricted. Also, since the second fixing rib 215 is inserted into the second fixing slot 118, the movement of the bracket 200 in one direction of the horizontal direction perpendicular to a direction in which the bracket 200 is detached from the main body 110 may be restricted. Also, since the second fixing rib 215 is hooked on the hook protrusion 119, the movement of the bracket 200 in one direction of the horizontal direction in which the bracket 200 is separated from the main body 110 may be restricted.

The driving rib 217 is disposed on the first part 210. When the bracket 200 is mounted on the main body 110, the driving rib 217 drives the driving member 133. For this, the driving rib 217 is elastically deformed with respect to the first part 210. In the current embodiment, the driving rib 217 is disposed on a side of the first part 210 adjacent to the first fixing rib 213. To elastically deform the driving rib 217, an elastic opening 219 is defined between the first fixing rib 213 and the driving rib 217.

The second part 220 is a part for horizontally moving the bracket 200 with respect to the main body 110, i.e., manipulated by a user to mount or separate the bracket 200 on or from the main body 110. The second part 220 bent from a rear end of the first part to extend. For example, when the bracket 200 is mounted on the main body 110, the second part 220 is in contact with the rear surface of the main body 110.

A second opening 221 is defined in the second part 220. The second opening 221 prevents the discharge of air through the discharge hole 112 from interfering with the bracket 200. For this, a portion of the second part 220 corresponding to the discharge hole 112 is cut in a state where the bracket 200 is mounted on the main body 110 to define the second opening 221.

Also, a grasp part 223 is disposed on the second part 220. The grasp part 223 extends backward from a side of the second part 223, e.g., an upper end of the second part 220. The grasp part 223 is a part that is substantially grasped by the user to horizontally move the bracket 200 with respect to the main body 110.

Hereinafter, an operation of the robot cleaner according to an embodiment will be described.

To perform a cleaning operation by using the damping cloth, the damping cloth is mounted on the bracket 200. As described above, the damping cloth may be mounted on the first part 210.

In this state, the bracket 200 horizontally moves from a rear side of the main body 110. That is, in a state where the bottom surface of the main body 110 is disposed to face a lower side, the bracket 200 moves forward from the rear side of the main body 110 to mount the bracket 200 on the main body 110.

In detail, while the bracket 200 moves forward, the bracket 200 is guided by the guide rib 113. Here, even though the bracket 200 moves forward in a state where the bracket 200 is not precisely aligned with the guide rib 113 in the front and rear directions, the bracket 200 may be mounted in position with respect to the main body 110 by the inclined guide part 114 disposed on the rear end of the guide rib 113.

When the bracket 200 moves forward and then is mounted on the main body 110, the first and second fixing ribs 213 and 215 are respectively inserted into the first and second fixing slots 116 and 118. Here, while the second fixing rib 215 is inserted into the second fixing slot 118, the second fixing rib is elastically deformed, and the hook protrusion 119 is hooked on the hook 216.

Also, when the bracket 200 is mounted on the main body 110, the driving rib 217 is inserted into the driving groove 131. When the driving rib 217 is inserted into the driving groove 131, the driving member 133 moves to turn the micro switch 137 on. Thus, it is detected that the bracket 200 is mounted on the main body 110.

The robot cleaner 100 may perform the cleaning operation by using the damping cloth only when the mount of the bracket 200 on the main body 110 is detected. The cleaning operation using the damping cloth may be performed in a cleaning region except for a cleaning region such as a carpet and also performed without moving in other regions that are partitioned by a constitution such as a door frame.

Figure 5:
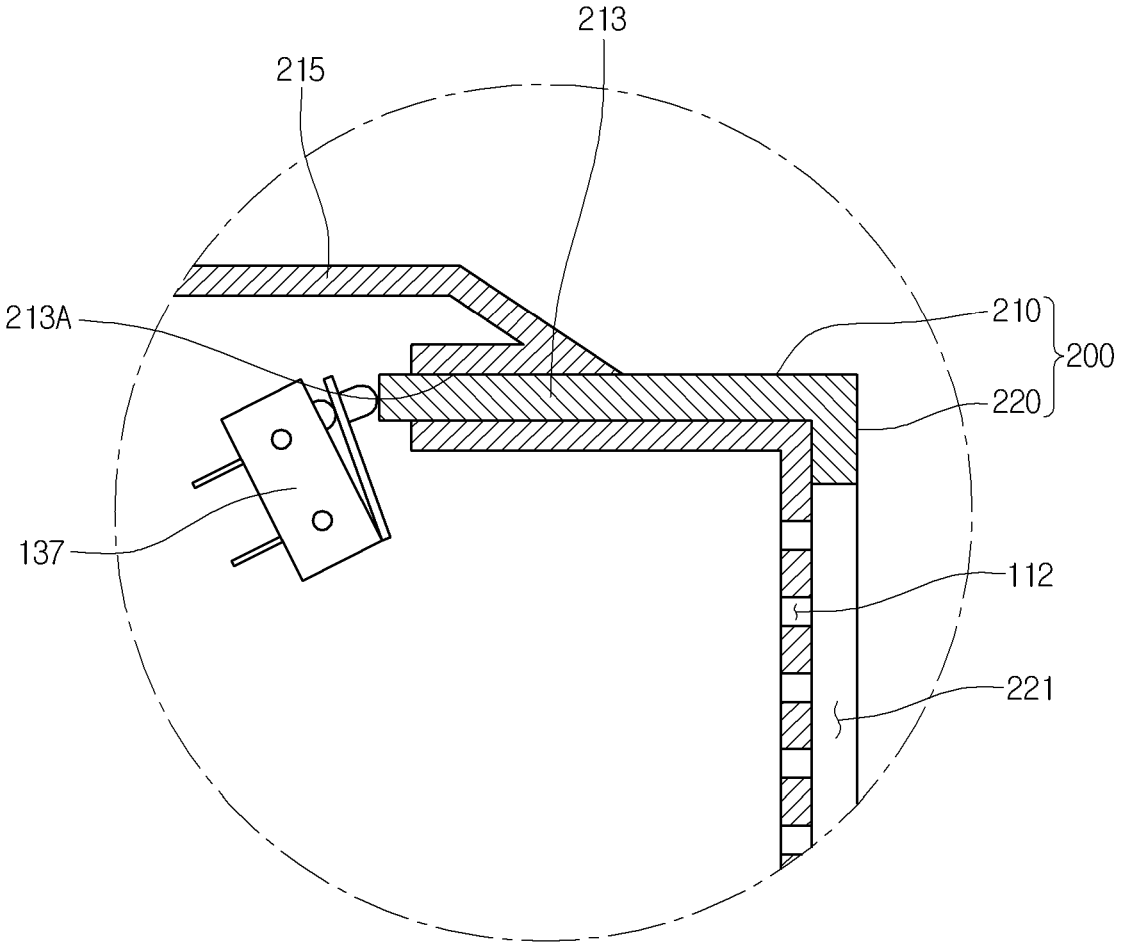
FIG. 5 is a longitudinal sectional view illustrating a portion of a robot cleaner according to another embodiment.

FIG. 5 is a longitudinal sectional view illustrating a portion of a robot cleaner according to another embodiment. The same parts as those of the foregoing embodiment will be derived from FIGS. 1 to 3, and thus detailed descriptions thereof will be omitted.

Referring to FIG. 5, in the current embodiment, a micro switch 137 constituting a detection device is disposed adjacent to a first fixing slot 116. Also, the micro switch 137 is driven by a first fixing rib 213 inserted into the first fixing slot 116. Thus, in the current embodiment, the driving rib 217 and the driving member 133 of the foregoing embodiment may be removed.

In detail, a through hole 116A is defined in a front end of the first fixing slot 116. Also, when the first fixing rib 213 is inserted into the first fixing slot 116, a front end of the first fixing rib 213 passes through the through hole 116A and then is inserted into a main body 110 to turn the micro switch 137 on. Also, when the first fixing rib 213 is separated from the first fixing slot 116, the micro switch 137 that is turned on by the first fixing rib 213 is turned off.

In the above-described embodiment, the first fixing slot and the first fixing rib are disposed at further front sides of the main body 110 and the bracket in a moving direction of the main body 110 than a second fixing slot and a second fixing rib. However, the first fixing slot and the first fixing rib may be disposed at further rear portions of the main body 110 and the bracket in the moving direction of the main body 110 than the second fixing slot and the second fixing rib.

Also, in the above-described embodiment, the driving member 133 is driven by the first fixing rib. However, the driving member 133 may be driven by the second fixing rib. In this case, the detection device may be disposed within the main body 110 adjacent to the second fixing slot.

In the above-described embodiments, the micro switch is turned on or off by the driving rib or one of the first and second fixing ribs, i.e., the driving member driven by the bracket. However, the driving member may be removed, and thus, the micro switch may be directly driven by the bracket and then turned on or off.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner comprising:

a main body having a plurality of fixing slots that are spaced apart from each other;

a moving device providing a driving force for moving the main body; and a bracket on which a cleaning member is mounted, the bracket comprising a plurality of fixing ribs that horizontally move and are respectively coupled to the plurality of fixing slots, wherein the bracket comprises:

a first part on which the cleaning member is mounted, the first part comprising the plurality of fixing ribs; and a second part on which a grasp to be grasped by a user is disposed, the second part extending from the first part, wherein the bracket is coupled to the main body in front and rear directions of the main body.

2. The robot cleaner according to claim 1, wherein the plurality of fixing slots are spaced apart from each other in left and right directions of the main body.

3. The robot cleaner according to claim 1, wherein the plurality of fixing slots are spaced apart from each other in front and rear directions of the main body.

4. The robot cleaner according to claim 1, wherein the plurality of fixing slots comprise a first fixing slot, and the plurality of fixing ribs comprise a first fixing rib, wherein the first fixing slot is defined by cutting a portion of a protrusion that protrudes downward from a bottom surface of the main body.

5. The robot cleaner according to claim 4, wherein the bracket has an opening for preventing an interference with the protrusion.

6. The robot cleaner according to claim 4, wherein an auxiliary wheel for assisting the movement of the main body is disposed on a bottom surface of the main body, and an opening for preventing an interference with the auxiliary wheel is defined in the bracket.

7. The robot cleaner according to claim 1, wherein the plurality of fixing slots comprise a second fixing slot, and the plurality of fixing ribs comprise a second fixing rib, wherein the second fixing slot comprises a hook protrusion, and the second fixing rib comprises a fixing hook that is hooked on the hook protrusion.

8. The robot cleaner according to claim 1, wherein the first part is disposed on a lower portion of the main body; and the second part is disposed on a rear portion of the main body.

9. The robot cleaner according to claim 8, wherein a discharge hole through which air suctioned into the main body is discharged is defined in the main body, and an opening through which the air discharged from the discharge hole passes is defined in the second part.

10. The robot cleaner according to claim 1, wherein a plurality of guide ribs spaced apart from each other are disposed on the bottom surface of the main body to guide mounting of the bracket in a horizontal direction.

11. The robot cleaner according to claim 10, wherein an inclination guide part for guiding the mounting of the bracket so that the bracket is disposed between the plurality of guide ribs is disposed on the bottom surface of the main body.

12. The robot cleaner according to claim 1, further comprising a micro switch driven by the bracket, the micro switch being turned on or off according to whether the bracket is mounted on the main body.

13. The robot cleaner according to claim 1, further comprising:

a driving member driven by the bracket mounted on the main body;

an elastic member applying an elastic force to the driving member so that the driving member is driven in a direction opposite to a direction in which the bracket is driven; and a micro switch turned on or off by the driving of the driving member.

14. A robot cleaner comprising:

a main body comprising a first fixing slot and a second fixing slot spaced apart from the first fixing slot;

a bracket on which a cleaning member is mounted, the bracket comprising a first fixing rib inserted into the first fixing slot and a second fixing rib inserted into the second fixing slot; and a detecting unit disposed at the main body to detect whether the bracket is mounted on the main body, wherein each of the fixing ribs of the bracket is inserted into each of the fixing slots of the main body in a direction parallel to front and rear directions of the main body.

15. The robot cleaner according to claim 14, wherein the first fixing slot is defined by cutting a portion of a protrusion in which a portion of a bottom surface of the main body protrudes downward, and an opening in which the protrusion is disposed in a state where the bracket is mounted on the main body is defined in the bracket.

16. The robot cleaner according to claim 14, wherein the bracket comprises:

a first part on which the cleaning member is mounted, the first part being disposed adjacent to a bottom surface of the main body; and a second part integrated with the first part, the second part being disposed adjacent to a rear surface of the main body.

17. The robot cleaner according to claim 16, wherein the first and second fixing ribs are disposed on the first part, and a grasp part to be grasped by a user to mount or separate the bracket on or from the main body is disposed on the second part.

18. The robot cleaner according to claim 16, wherein an opening for avoiding interference with an auxiliary wheel disposed on the bottom surface of the main body is defined in the first part, and an opening through which air discharged to the outside of the main body passes is defined in the second part.

19. The robot cleaner according to claim 14, wherein the detecting unit comprises a micro switch that is turned on or off by the bracket mounted on or separated from the main body.

20. A robot cleaner comprising:

a main body having one or more fixing slots;

a moving device providing a driving force for moving the main body;

an auxiliary wheel provided on a bottom surface of the main body; and a bracket on which a cleaning member is mounted, the bracket comprising one or more fixing ribs that are respectively coupled to the one or more fixing slots, wherein the bracket comprises an opening for avoiding interference with the auxiliary wheel, and the auxiliary wheel passes through the opening when the bracket is coupled to the main body.

* * * * *